US005718343A

United States Patent [19]

Belokin et al.

[11] Patent Number: 5,718,343

[45] Date of Patent: Feb. 17, 1998

[54] SUSPENDED DISPLAYS

[76] Inventors: Paul Belokin; Martin P. Belokin, both of 7801 I-35 North, Denton, Tex. 76202; Norman P. Belokin, 1606 Oak Ridge, Corinth, Tex. 76205

[21] Appl. No.: 781,439

[22] Filed: Jan. 13, 1997

[51] Int. Cl.[6] ..... A47B 43/00; A47B 47/00; A47B 57/00

[52] U.S. Cl. ..... 211/188; 211/118

[58] Field of Search ..... 211/188, 186, 211/113, 118, 59.2

[56] References Cited

U.S. PATENT DOCUMENTS

| | | | |
|---|---|---|---|
| 2,595,002 | 4/1952 | Sceneider | 211/186 |
| 3,938,666 | 2/1976 | Castleberry | 211/113 |
| 4,442,778 | 4/1984 | Lang | 211/186 |
| 4,763,796 | 8/1988 | Flum | 211/59.2 |
| 4,901,872 | 2/1990 | Lang | 108/91 |
| 4,961,506 | 10/1990 | Lang | 211/186 |

*Primary Examiner*—Milton Nelson, Jr.
*Assistant Examiner*—Anthony D. Barfield
*Attorney, Agent, or Firm*—Jack A. Kanz

[57] ABSTRACT

A suspendable assembly for displaying goods at approximately customer eye level is formed by two elongated side members on which are mounted at least two display trays. The trays have slots therein for insertion of the elongated side members and a sidewall portion with an upturned flange. The side members have tray-supporting bosses which increase in size with descending position and the slots in the trays increase in length with relative descending position so that the lower trays will pass over the upper bosses but not over the lower bosses. The bosses are aligned to support the floor of each tray tilted downwardly in the direction of the upturned flange.

9 Claims, 4 Drawing Sheets

SUSPENDED DISPLAYS

This invention relates to arrangements for holding and displaying merchandise. More particularly, it relates to assemblies suspended from the ceiling of a retail store or the like used to display merchandise, thereby utilizing formerly unused space and providing customer-attracting motion for the displayed goods.

BACKGROUND OF THE INVENTION

Various constructions of display arrangements such as multi-faceted display stands provided with one or more shelves, bins, receptacles or the like for the goods to be displayed are widely used. Display stands of this type are intended for use in store aisles and at similar locations where potential customers may approach the display stand from different directions or move about the stand to examine the goods on display.

Convenience stores have highly refined the art of displaying the maximum amount of goods in the minimum amount of floor space. Such stores typically have several aisles of open shelf displays, a number of refrigerated sections behind glass doors and counter space for hot and cold drink dispensers and unpackaged goods such as doughnuts and the like. The open shelf displays, however, are rarely over five feet in height and the space above counters is usually vacant. Thus, there remains substantially large amounts of space above the shelves in such stores which is not used for display of goods because display assemblies for holding and displaying goods in the open space above counters and elsewhere have not herefore been available. Convenience stores do not have floor space to spare for the typical floor-mounted display stands used by larger supermarkets, hardware stores and the like.

Convenience stores typically have drop-style suspended ceilings which use a grid of supports spanning the ceiling. Such drop-style suspended ceilings include a plurality of parallel supports suspended from the interior superstructure of the building. The supports are generally in the shape of an inverted T having horizontal portions supported by a vertical portion. Ceiling tiles are supported on the grid. Spacings of grid supports are standardized and, along with a variety of creative brackets designed to hold heavy merchandise and to be securely attached to hung ceilings, provide adequate support for the suspended displays contemplated herein. Appropriate attachment systems which depend from such ceilings for supporting the suspended displays contemplated by this invention are available. One such support system is disclosed in application for U.S. patent Ser. No. 08/588,547 filed Jan. 18, 1996 which is incorporated herein by reference.

Prior suspended displays for merchandise have been found unsatisfactory for a variety of reasons. Most lack either adequate support and/or stability. Some are difficult to assembly and use and some are simply too expensive to be of practical use. A need thus exists for apparatus which promotes display of merchandise in the space above floor stands, counter tops and the like yet overcome the deficiencies of prior devices. The displays must provide product presentation at approximately customer eye level and, preferably, act in a manner to attract the attention of the customer. However, the display assembly must be easy to assemble and use and must be inexpensive and reliable.

SUMMARY OF THE INVENTION

In accordance with the present invention a suspended display assembly is provided which supports and presents merchandise products at approximately customer eye level in a place of business. The suspended display assembly takes advantage of space above counter tops, etc., which is otherwise unused and, since it is suspended, permits movement which attracts customers. The assembly of the invention is formed of simple, inexpensive mass-produced parts which can be easily and readily assembled into useable display racks. Multiple units may be attached together to form larger displays.

The assembly of the invention comprises a pair of side members with upper bosses and lower bosses extending therefrom which support at least two trays thereon. The trays have slots which fit over the side members. The lower bosses are wider than the upper bosses and the lower tray has wider slots than the upper tray. Thus the lower tray is assembled on the side members by sliding the side members and the upper bosses through the slots on the lower tray. The lower tray then rests on the lower (wider) bosses. The upper tray then slides over the side members and rests on the upper bosses.

The novel features which are considered characteristic of the invention are set forth in particular in the appended claims. The invention, however, both as to its construction and operation, will be best understood from the following description taken in connection appended claims and attached drawing in which:

BRIEF DESCRIPTION OF THE DRAWING

Like numerals have been used to identify like parts throughout the several views of the drawing.

DESCRIPTION OF THE PREFERRED EMBODIMENTS

Figure 1:
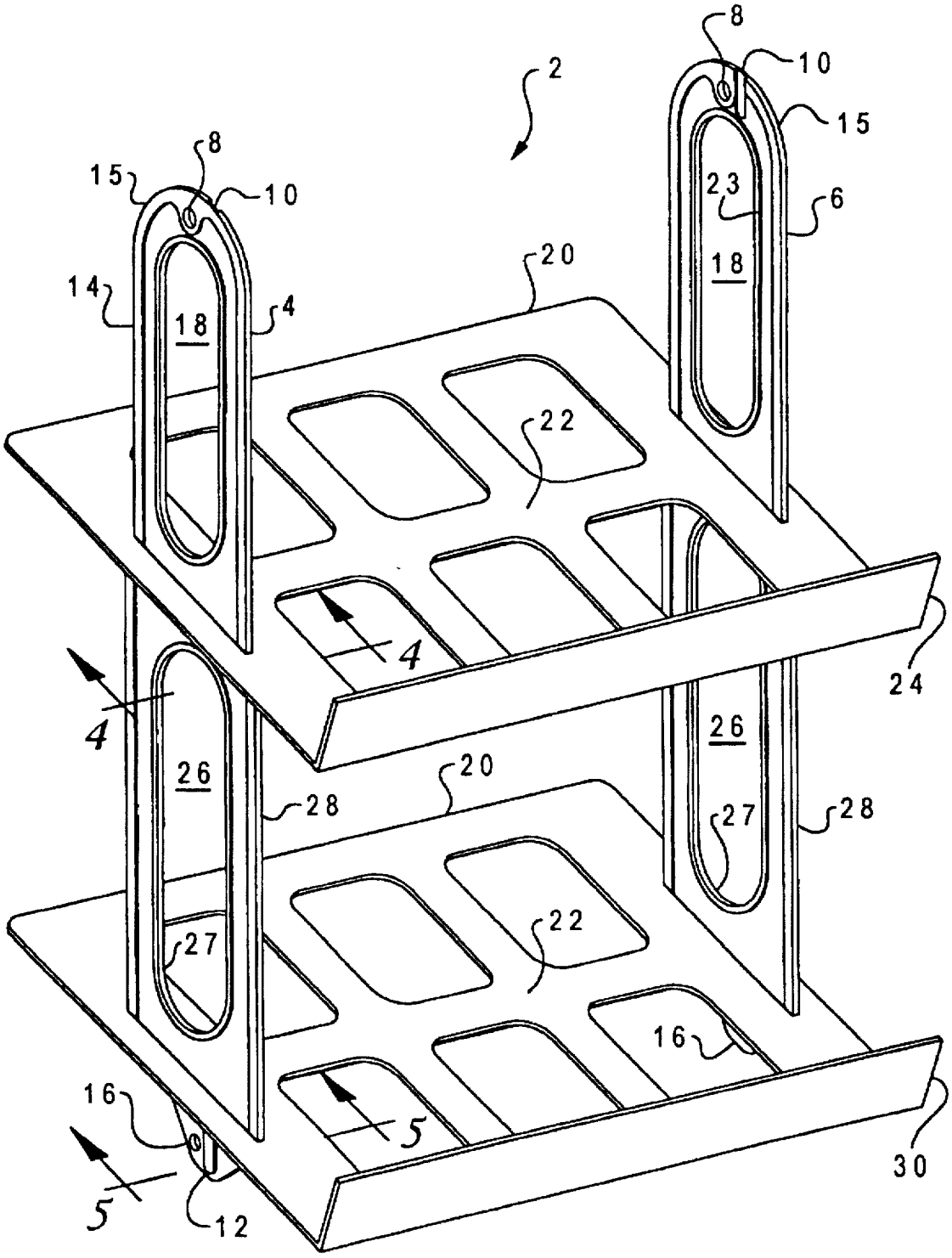
FIG. 1 is a perspective view of a preferred embodiment of a display assembly incorporating the priciples of the invention.

Display assembly 2 includes as its major components a pair of elongated mirror image side members 4 and 6, each having pin openings 8 and grooves 10 at their extreme ends. The grooves 10 are adapted to mate with locking ribs 12 when two or more display assemblies 2 are connected for common suspension. The elongated side members 4 and 6 may have, for example, reinforcement rims 14 and 28 along the perimeters thereof. The elongated side members 4 and 6 each have upper first end portions 15 and lower second end portions 16 and also have upper elongated openings 18 and lower elongated openings 26 with reinforcement rims 23, 27. It will be appreciated, however, that features such as openings 18 and rims 23, 27 are conventional engineering details for maximizing strength of the product while minimizing cost.

The display assembly 2 as shown in FIG. 1 has two trays 20 mounted on the elongated side members 4 and 6. The trays 20 each define a floor 22 for supporting merchandise or the like. The floors 22 tilt downwardly toward the forward position and terminate in flanges 24, 30. The trays are mounted with a forward downward pitch for displaying goods thereon and the flanges 24, 30 maintain the goods on the trays 20. The floors 22 may, of course, be solid and/or level. Various other configurations are also contemplated.

Figure 2:
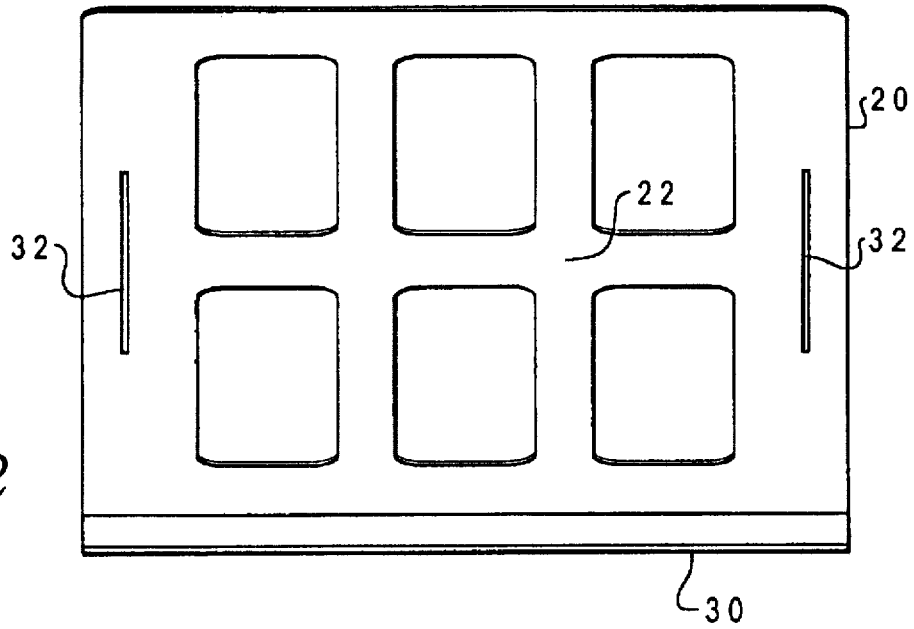
FIG. 2 is a top plan view of the assembly of FIG. 1.

As shown in FIG. 2 each tray has slots 32 which allow mounting of the tray on the elongated side members 4 and 6. The dimensions of the slots 32 determine the relative positions of the trays, i.e., the top tray 20 has shorter slots than the bottom tray, allowing the trays to be selectively positioned on the elongated side members 4 and 6.

Figure 3A:
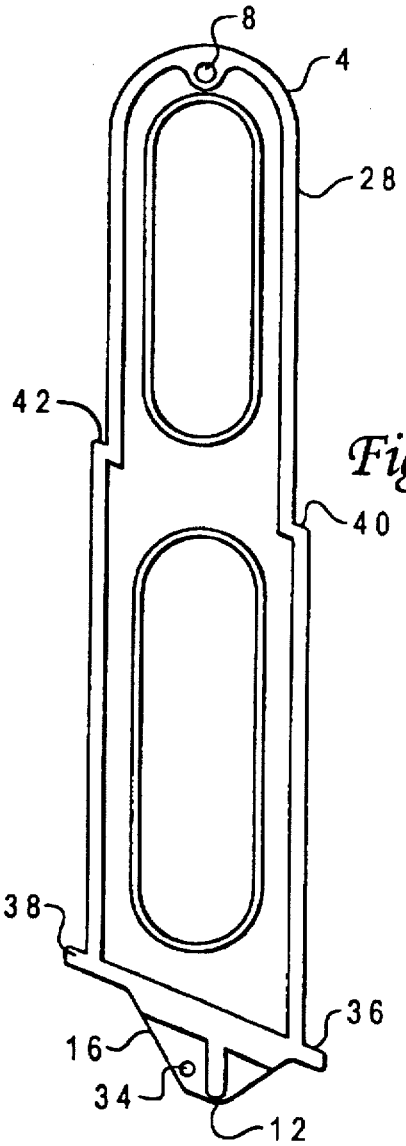
FIG. 3*a* is an elevational view of a side member of the assembly of FIG. 1.

As shown in FIG. 3*a* side member 4 has a pair of upper bosses or shoulders 40, 42 extending therefrom at approximately the midpoint of the side member 4. A second pair of bosses or shoulders 36, 38 extend from the lower end of the side member 4 and are substantially parallel with bosses on shoulders 40, 42. The end-to-end distance, however, between the ends of lower bosses 36, 38 is larger than the end-to-end distance between upper bosses 40, 42. The lower end portion 16 also has a guide rib 12 which, combined with the pin opening 34, provides fixed joinder with a second display assembly.

Figure 3B:
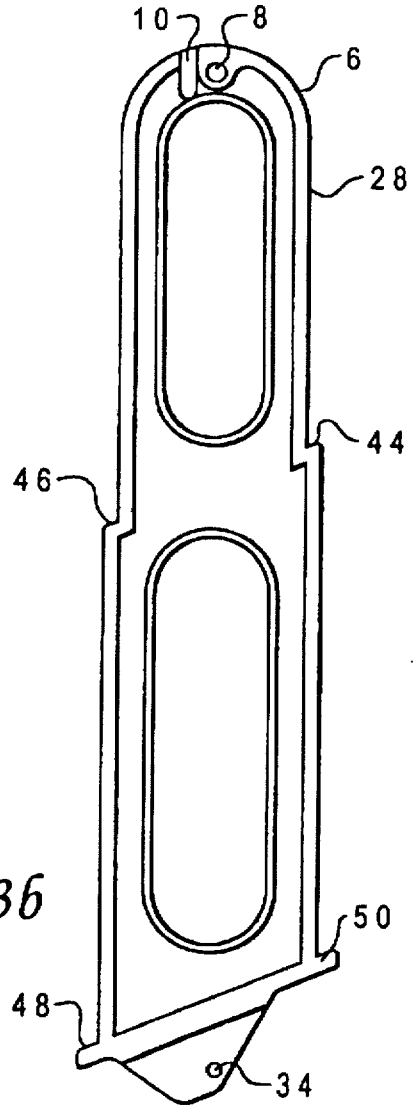
FIG. 3*b* is an elevational view of a second side of the side member of FIG. 3*a;*

Mirror image side member 6 is shown in FIG. 3*b*. The side members 4, 6 are mirror images of one another with elongated side member 6 having a pair of upper tray mounting shoulders 44, 46 and a pair of lower tray mounting shoulders 48, 50.

Figure 3C:
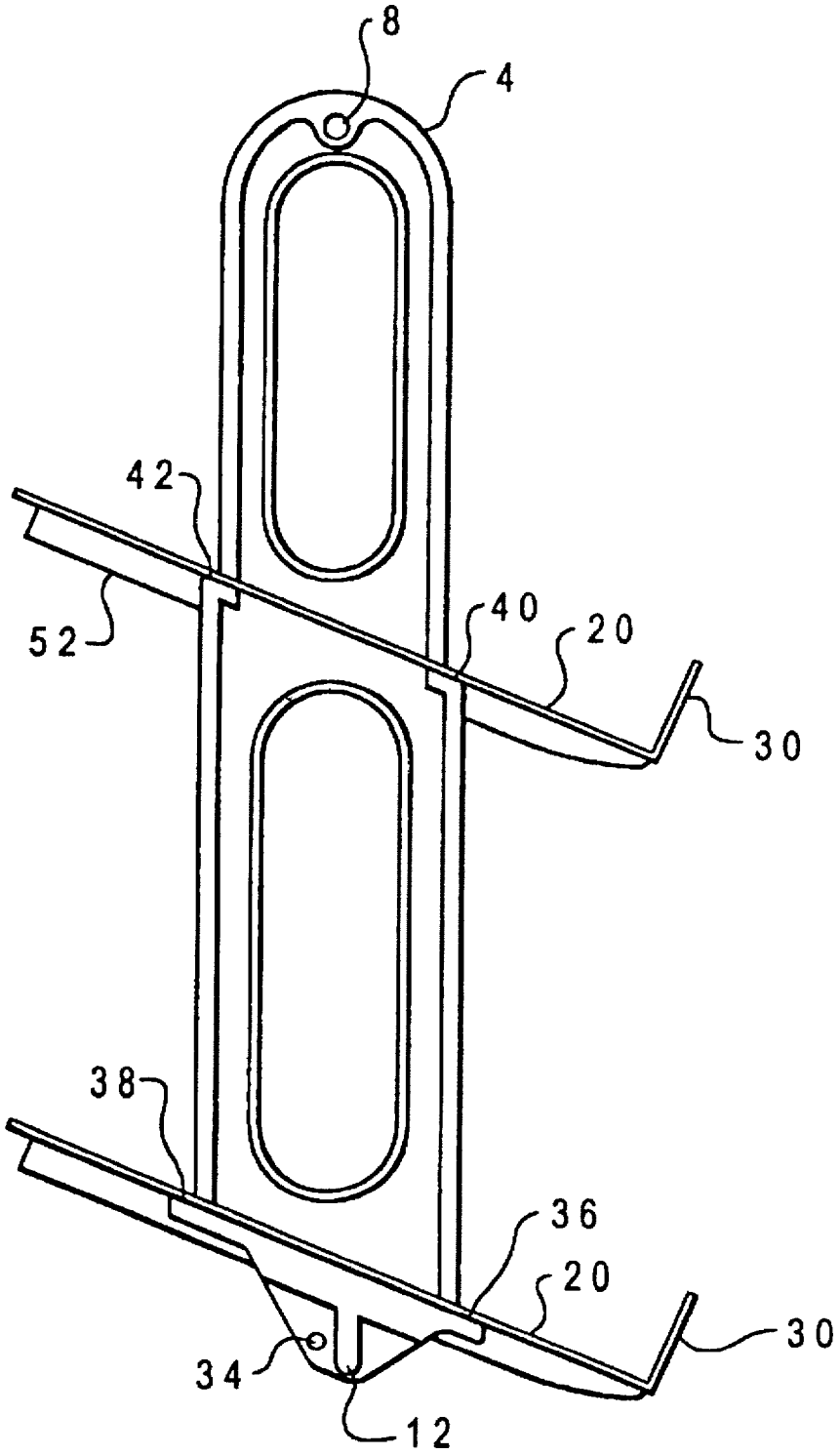
FIG. 3*c* is a side view of the display assembly of FIG. 1.

The assembled display unit 2 is shown in FIG. 3*c*. The assembly is adapted to be suspended from overhead fixtures or the like with ropes, chains, strings or the like attached at the pin openings 8, thus suspending the display assembly 2 with the elongated side members 4 and 6 substantially vertical.

When the display assembly 2 is suspended with the elongated side members 4 and 6 in substantially vertical positions, the trays 20 are positioned on the upper tray mounting shoulders 40, 42 and lower tray mounting shoulders 38 and 36 so that the tray 20 slopes downwardly toward tray flanges 30. The forward downward sloping of the trays 20 invites ready viewing of the displayed goods at eye level and allows for the viewer to remove such goods at will.

Figure 5:
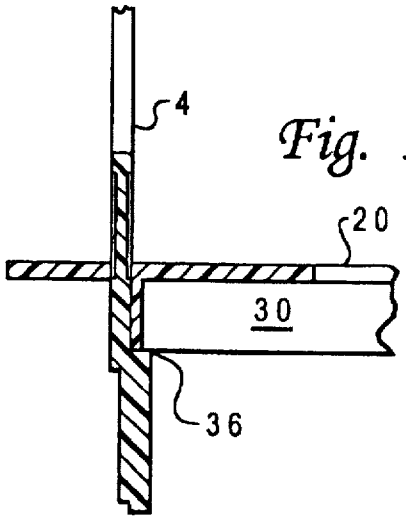
FIG. 5 is a partial sectional view of the assembly of FIG. 1 taken along line 5—5.
Figure 4:
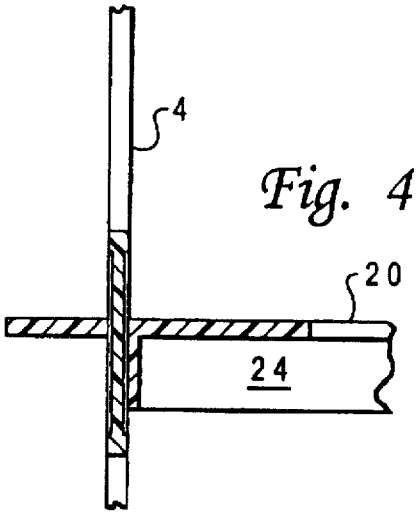
FIG. 4 is a partial sectional view of the assembly of FIG. 1 taken along line 4—4.

A cross-sectional view of an upper tray mounted on an elongated side member 4 is shown in FIG. 4. FIG. 5 illustrates a tray mounted on the lower mounting shoulders.

Figure 6:
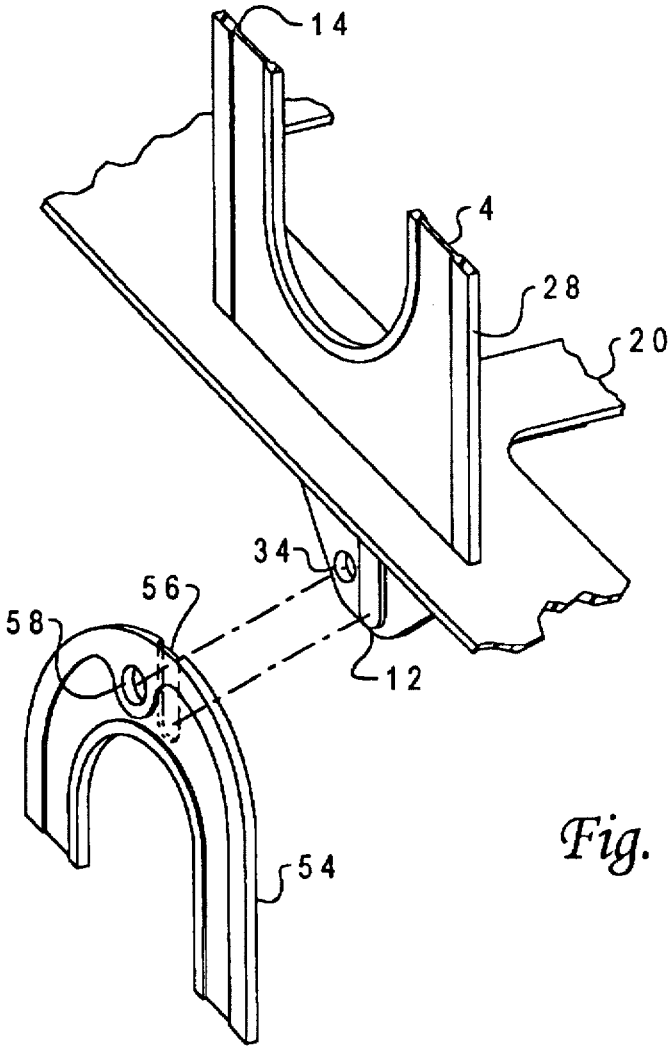
FIG. 6 is a fragmentary exploded perspective view of the interconnecting ends of a first and second display positioned for joinder.

In the exploded partial perspective view of FIG. 6, two side members 4, 54 are joined by insertion of guide rib 12 of member 4 into a groove 56 of member 54. This positions the two elongated side members with pin openings 34 and 58 in registry. Joinder can be finalized by inserting a pin (not shown) through pin openings 34 and 58. The side members 4, 54 are thus rigidly joined and act as a unitary one-piece display.

The suspended display assemblies of the invention can be fitted with one or more additional assemblies (depending on the display space available) and provide additional product display. Flexible suspension elements such as wires, chains, ropes and the like (not shown in the drawing but attachable, for example, through upper pin openings 8) allow the suspended display assemblies to be flexible and move (within limits) in all directions. Thus, when bumped by customers or store personnel (without causing injury to the personnel, customers or to the display assemblies) the suspended displays move and attract attention to the supported merchandise.

The suspended display assemblies of the invention can be formed in a wide variety of different sizes and shapes to permit suspension from the ceiling or overhead support means over counters in the high traffic areas of the store. Such assemblies may be constructed of a variety of materials utilizing strength and weight relationships wherein the highest strength is achievable with minimum weight. They may be constructed, for example, of cardboard, plastic, sheet metal and the like, depending on the weight, size, character and cost of products to be sold.

While the invention has been described and illustrated herein as embodied in a specific construction of a multifaceted display assembly including a plurality of assemblies and trays and construction components, it is not intended to be limited to the details of this particular construction, since various modifications and structural changes may be made without departing from the spirit of the present invention as defined by the appended claims.

What is claimed:

1. A display assembly suspendable from overhead support structure comprising:

(a) two elongated side members of substantially identical dimensions and shape, each defining a first pair of upper bosses and a second pair of lower bosses;

(b) a first display tray having a floor with slot openings therein supported on said side members by said lower bosses with said side members extending through said slot openings;

(c) a second display tray having a floor with slot openings therein supported on said upper bosses with said side members extending through said slot openings; and (d) suspension and connection fixtures at the extreme end portions of each of said elongated side members comprising:

(i) holes in the end portions of each said side member; and (ii) at least one rib in one end portion of each said side member adapted to mate with a groove in the opposite end of an adjoining side member.

2. A display assembly as defined in claim 1 wherein each of said trays has an upturned flange.

3. A display assembly as defined in claim 1 wherein said bosses are sized and arranged so that said upper bosses pass through the slots in said first tray and do not pass through the slots in said second tray.

4. A display assembly as defined in claim 3 wherein the length of the slots in the first tray is greater than the length of the slots in said second tray.

5. A display as defined in claim 1 wherein the bosses on said side members support said trays with the floors of said trays tilted with respect to a horizontal direction.

6. A display assembly as defined in claim 1 wherein said connection fixtures comprise mating grooves and guide ribs, a first end portion of one said side members having a groove which mates with a guide rib on an end portion of an adjoining side member providing alignment between holes in the mating end portions.

7. A display assembly as defined in claim 1 wherein said display trays are mounted substantially parallel with each other.

8. A display assembly as defined in claim 7 wherein said display trays are mounted with the floors thereof substantially horizontal.

9. A merchandise display assembly suspendable from overhead support structure comprising:

(a) two elongated side members of substantially identical dimensions and shape, each defining suspension support fixtures at a first end portion thereof and connection fixtures for securing another elongated side member to a second end portion thereof and having a first set of bosses for supporting a first tray and a second set of bosses for supporting a second tray;

(b) a first tray having slot openings on opposite sides thereof, the size and shape of the slots in the first tray being sufficient to pass over said first end portion of said side member and said second set of bosses but not over said first set of bosses; and (c) a second tray having slot openings on opposite sides thereof, the size and shape of the slots in said second tray being sufficient to pass over the first end portion of said side member but not over said second set of bosses.

* * * * *